United States Patent [19]

Wasem

[11] Patent Number: 4,767,006

[45] Date of Patent: Aug. 30, 1988

[54] HOLDER FOR ALLEN WRENCHES

[76] Inventor: Keith Wasem, 220 S. Spruce St., Nazareth, Pa. 18064

[21] Appl. No.: 143,839

[22] Filed: Jan. 14, 1988

[51] Int. Cl.[4] ..... B65D 85/20

[52] U.S. Cl. ..... 206/377; 7/167; 206/376

[58] Field of Search ..... 7/138, 168, 167; 81/436, 440; 206/372-378

[56] References Cited

U.S. PATENT DOCUMENTS

| | | | |
|---|---|---|---|
| 2,409,613 | 10/1946 | Brooks | 81/436 |
| 2,465,619 | 3/1949 | Yeit | 206/377 |
| 2,715,028 | 8/1955 | Dossie | 81/436 |
| 2,786,380 | 3/1957 | Rolland | 81/436 |
| 3,892,149 | 7/1975 | Rydberg | 81/440 |
| 4,010,663 | 3/1977 | Rydberg | 81/440 |
| 4,101,025 | 7/1978 | Jordan | 206/377 |
| 4,440,048 | 4/1984 | Stevens et al. | 81/440 |

*Primary Examiner*—Jimmy G. Foster

*Attorney, Agent, or Firm*—Steele, Gould & Fried

[57] ABSTRACT

A holder for allen wrenches includes a hollow cylindrical housing and in interior cylindrical rod which holds the wrenches. The interior rod includes longitudinal channels in graduated widths, each channel terminating in a bore into the rod in which the head of the wrench is placed. The housing prevents the wrenches from escaping from their channels unless the interior cylinder is rotated into a position which exposes a wrench to a slot and thumb hole. A stand and handles for rotating the rod are provided. Locking means are also provided to lock the rod in the housing in a position where no wrenches are able to be drawn from the housing.

14 Claims, 3 Drawing Sheets

HOLDER FOR ALLEN WRENCHES

BACKGROUND OF THE INVENTION

1. Field of the Invention

This invention relates to a holder for a plurality of allen wrenches or similar tools.

2. Description of the Prior Art Workmen carry their tools in many kinds of tool boxes or the like receptacles. Often these boxes are provided with dividers into which a variety of tools may be placed. Some tools, such as drill bits, ratchet drivers, screw drivers and wrenches come in a variety of graduated sizes. The common toolbox does not provide for individual storing of tools by size, but rather usually provides several general storage areas. It is very helpful to the workman to have similar tools of graduated sizes arranged so that the desired size is readily at hand and not easily lost. To this end, many tool holders, tool boxes, kits and cases have been designed.

In particular, allen wrenches, because they are generally straight rods of only slightly varying sizes, are easily mislaid or not quickly found among the other tools. Some specialized holders for allen wrenches have been designed. Among these is Jordon U.S. Pat. No. 4,101,025 which discloses a carrying case for wrenches. A soft sided carrying case with stitched pockets stores and carries a plurality of allen wrenches. In Jordan, the heads of the wrenches rest on top of each other.

Others have provided wrench holders in which the wrenches are stored permanently and the holder serves also as a handle. Among these are Brooks U.S. Pat. No. 2,409,613; Viet U.S. Pat. No. 2,465,619; and Rolland U.S. Pat. No. 2,786,380.

None of the prior art provides a rotatable holder for a plurality of allen wrenches which allows wrenches of any size to be stored in graduated order and be readily removable, yet closely retained in storage.

SUMMARY OF THE DISCLOSURE

The aforementioned prior art problems are obviated by the holder for allen wrenches of this invention. The holder has a hollow cylindrical housing which includes a longitudinal slot at least the length of the longest wrench to be stored. Inside the housing is a tool-holding cylindrical rod with a diameter slightly less than the diameter of the housing. Preferably, each end of the rod terminates in a hub. The interior rod also includes a plurality of longitudinal channels, each channel terminating in a bore into the rod. The rod also includes a circumferential groove intermediate the rod ends and alignad with the thumb hole of the housing. A wrench is stored lengthwise in each channel with its head extending downward into the bore. The wrenches cannot escape the channels unless the channel is aligned with the housing's longitudinal slot.

Preferably, the holder includes a stand, the stand having a base and two perpendicularly extending, parallel legs. The hubs of the rod extend through the legs of the stand. Handles are provided on each housing end, each handle attached to a hub by a pin through the stand's legs.

To remove a wrench from its channel, a user rotates the handles, thus rotating the interior rod to expose the wrench in the housing's slot. The thumb hole in the housing and the circumferential groove in the rod allow finger access for removal of the wrench.

It is also preferred to have means to lock the housing to the stand so that the housing does not rotate. Also preferably, means are provided to lock the rod in unmoving position inside the housing with no rod channels exposed to the housing slot.

It is, therefore, an object of this invention to provide a holder for allen wrenches which holds a plurality of wrenches in a rotatable holder.

It is another object of this invention to provide a holder for allen wrenches which provides storage for a graduated set of wrenches and allows selective removal of a wrench.

It is a further object of this invention to provide a holder for allen wrenches which includes locking means to prevent undesired rotation.

It is still a further object of this invention to provide a holder for allen wrenches which is mountable on a tool box.

It is yet another object of this invention to provide a holder for allen wrenches which is simple to operate and inexpensive to produce.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
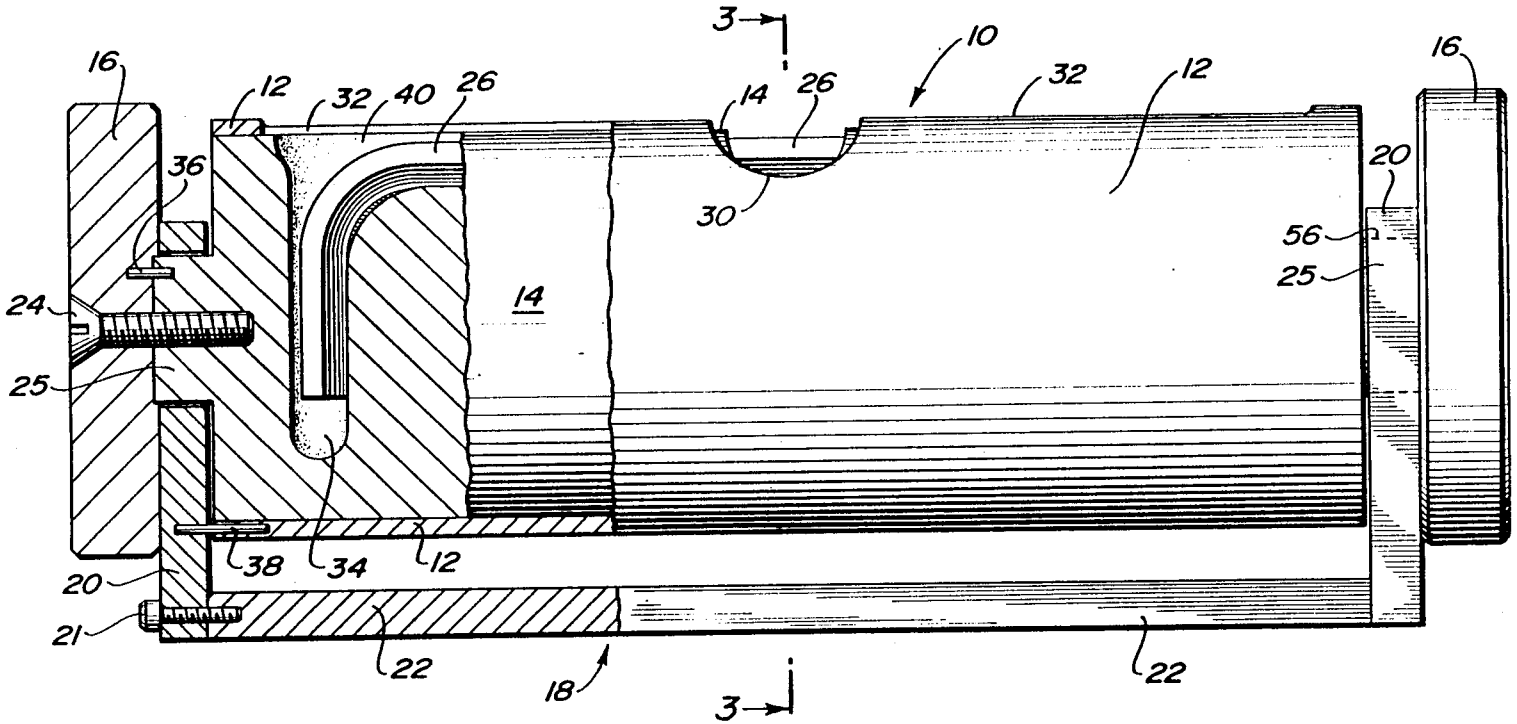
FIG. 1 is an elevational view in partial cross section illustrating the holder for allen wrenches of this invention.

Referring now to the drawings, and more particularly to FIG. 1, the holder for allen wrenches 10 is shown in partial cross section. Although reference is made throughout to allen wrenches, it should be understood that the holder is suitable for storing any rod-type tool or implement.

Holder 10 has hollow housing cylinder 12 and interior tool holding rod 14 which rotates inside housing 12. The circumference of housing 12 is only slightly larger than the circumference of interior tool holding rod 14. Thus when an allen wrench is stored in interior rod 14, housing 12 prevents its escape from rod 14 until rod 14 has been rotated into the proper position. Housing 12 is seen to have longitudinal slot 32 which is at least as long as the longest wrench to be stored. Midpoint of slot 32 is thumb hole 30. To remove a wrench, a user reaches into thumb hole 30, grasps the exposed wrench his thumb and forefinger, and lifts it through slot 32.

Interior rod 14 includes a plurality of longitudinal channels disposed around its circumference, only one of which is illustrated in FIG. 1 (channel 40). At one end of channel 40 is bore 34 into which the head of allen wrench 26 is placed. When interior rod 14 is in the position illustrated in FIG. 1, wrench 26 may be removed through slot 32 of housing 12.

In order to move each stored wrench into position for removal from housing 12, interior rod 14 rotates inside housing 12. To facilitate rotation, rod 14 includes, at each rod end, a hub 25 which is attached to a handle 16 by pin 24. As handle 16 is turned, rod 14 rotates, exposing different channels and their stored wrenches as they align with slot 32. If it is desired that no wrench be removed, rod 14 is rotated by handle 16 until no wrench is exposed in slot 32 and a locking mechanism is engaged to prevent further rotation. The locking mechanism will be further explained in reference to FIGS. 3 and 4.

In order to provide easy rotation of handles 16, housing 12 is supported on U-shaped stand 18. Stand 18 has base 22 and two vertical legs 20 held to base 22 by pins 21. Base 22 is of a length slightly greater than the length of housing 12, and both base 20 and legs 22 are approximately the same width. Legs 22 extend upward from base 22 at its ends to hold housing 12 therebetween. Dowel pins 38, which extend through legs 20 horizontally into cylinder housing 12, prevent housing 12 from rotating when handles 16 are turned. Each leg 20 also has a channel 56 through which hub 25 extends to be attached to handle 16 on the other side of leg 20. In order to hold hub 25 in constant registration to handle 16, it is preferred also to provide dowel rod 36 which extends into handle 16 and hub 25.

It may be desired to attach allen wrench holder 10 to a tool box. This may be accomplished by adding mounting means to base 22 which may then be attached to either top or side of a tool box.

Figure 2:
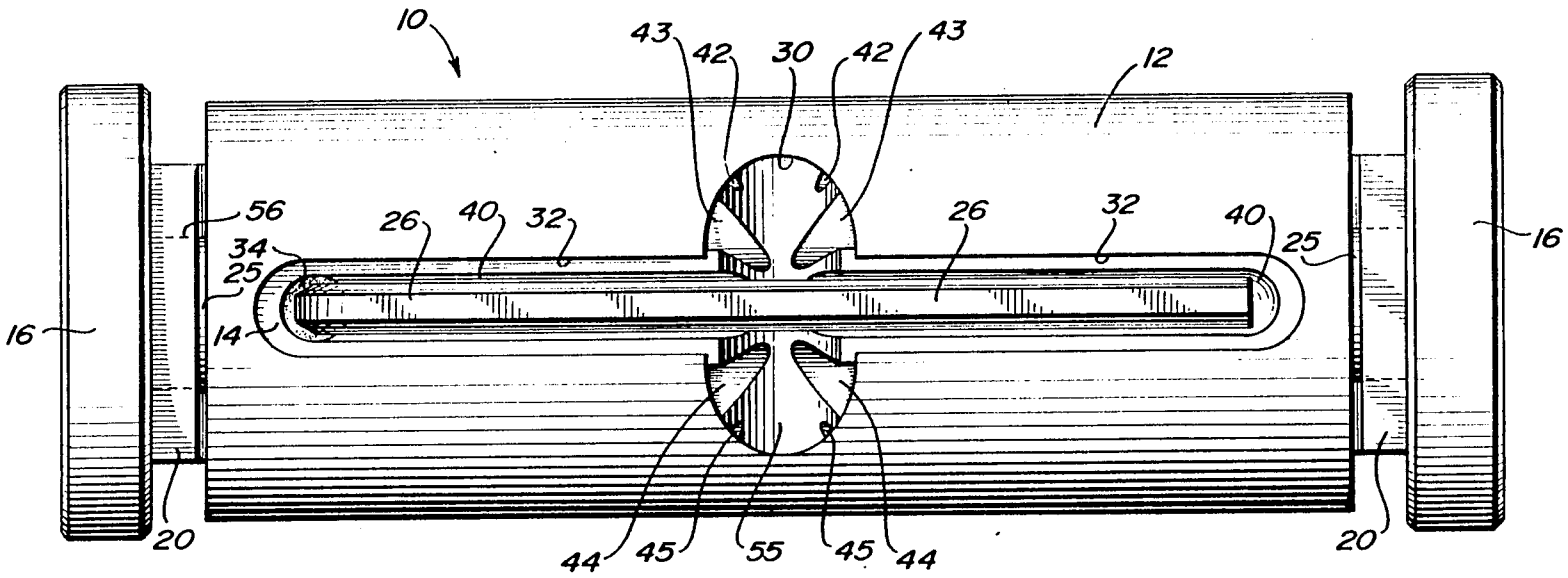
FIG. 2 is a top plan view of the holder for allen wrenches of this invention.

Referring now to FIG. 2, a top view of wrench holder 10 shows housing 12 supported between legs 20. Interior rod 14 is seen through slot 32 in housing 12. Hubs 25 are seen extending through channels 56 into handles 16. In order to remove a wrench from holder 10, a user rotates handles 16 until the desired wrench is in alignment with slot 32, the position illustrated in FIG. 2. He then reaches through thumb hole 30 and slot 32 to remove wrench 26 from its channel 40 and its head from bore 34.

Figure 5:
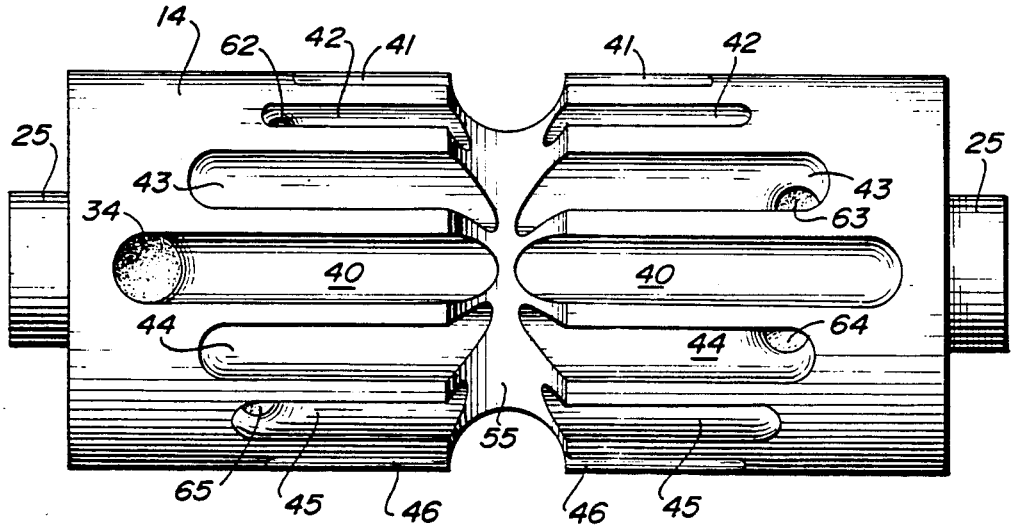
FIG. 5 is an elevation view of the tool holding interior rod.

Also visible through thumb hole 30 are the ends of channels 42, 43, 44 and 45, seen more fully in FIG. 5. Directly aligned with thumb hole 30 is circumferential groove 55 which circumscribes interior rod 14 at its longitudinal midpoint. Thumb hole 30 and groove 55 provide space for a user's fingers to reach around and grasp a wrench stored in one of the channels.

It may also be desired to place indicia on rod 12 at each channel to indicate the size of the wrench held in each channel.

Figure 3:
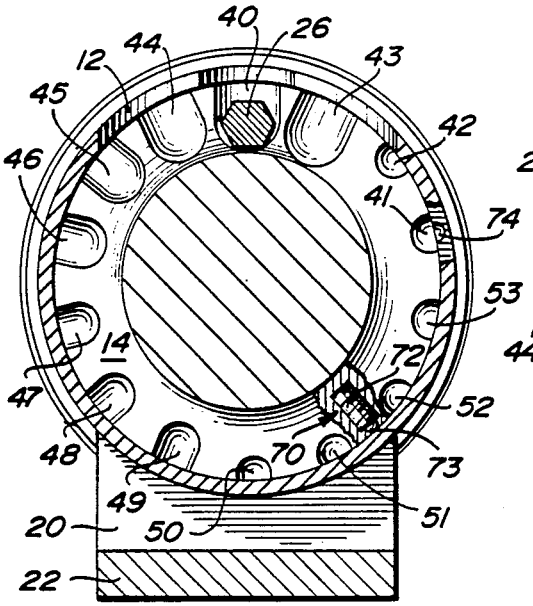
FIG. 3 is a cross section taken on lines 3—3 of FIG. 1 illustrating the interior rod rotated to a position for removal of a wrench.
Figure 4:
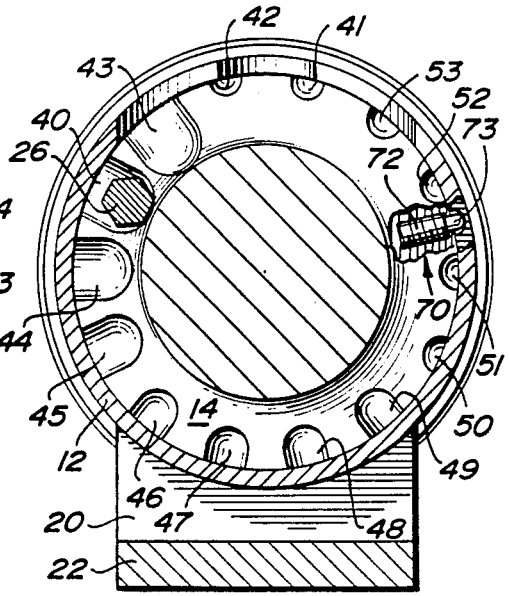
FIG. 4 is the same cross sectional view as FIG. 3 with the interior rod locked in a position where no wrenches may be removed from their channels.

Now referring to FIGS. 3 and 4, two cross sections show the interior of allen wrench holder 10. Stand base 22 and legs 20 are seen supporting housing 12 and interior rod 14. Tool holding rod 14 has channels 40, 41, 42, 43, 44, 45, 46, 47, 48, 49, 50, 51, 52 and 53, each preferably being of a different width to hold differently sized allen wrenches. In this Figure, only one wrench 26 is shown placed in a channel. It is preferred that interior rod 14 be a solid rod with the channels milled out and bores drilled at the channel ends. It can be seen that interior rod 14 has a diameter only slightly less than that of housing 12. Thus, any wrench held in a channel is held inside the channel by the combination of having its head in the bore and having its length resting in a channel and being retained in the channel by the fact that the inner wall of cylindrical housing 12 rides against the outer surface of rod 14.

Also seen in FIGS. 3 and 4 is locking mechanism 70 composed of plunger 73 and spring 72. Housing 12 includes indent 74 on its interior wall. When locking mechanism 70 is aligned with indent 74, pressure is released from spring 72 and plunger 73 slips into indent 74, preventing interior rod 14 from further rotation. When pressure is placed on plunger 73 by a user trying to turn rod 14, spring 72 is depressed, allowing plunger 73 to be released from indent 74 and interior rod 14 to rotate.

Now referring to FIG. 5, an elevational view of the tool holding interior rod 14 is shown. Rod 14 is a solid cylindrical rod with one hub 25 at each end and a plurality of longitudinal channels disposed around its circumference. Each channel ends at one end in a radial bore. It can be seen that channel 45 has bore 65; channel 44 has bore 64; channel 40 has bore 34; channel 43 has bore 63; and channel 42 has bore 62. The bores of channels 41 and 46 are not visible in this view. Additionally, at their longitudinal midpoints, the longitudinal channels join a circumferential groove 55 which provides room for a finger to reach under a wrench laying in a channel.

It can be seen in FIGS. 3, 4 and 5 that the size of the channels and bores varies, preferably in graduated sizes from 0.056" to $\frac{3}{8}$" in diameter to accept allen wrenchs of graduated diameters. The number and size of the channels is, of course, a matter of choice of manufacture.

There are several variations which can be practiced in the scope of this invention. The wrench holder may be milled from metal or formed of plastics.

The number and width of the channels and bores is a choice of manufacture.

The locking mechanism is optional and other locking mechanisms are included in the scope of this invention.

The stand is illustrative only and any mode of support which allows for rotation of the rod in the housing is intended to be included in the scope of this invention.

Pin means are shown to hold the hub to the wheel, but other means are within the scope of this invention.

There are many advantages to the allen wrench holder of this invention. Chiefly it provides convenient storage for a number of similar, but differently sized, tools. It is easy to remove the tools from their storage and yet they do not fall from their channels and cannot be removed unless the channel is properly aligned with the housing's slot.

Having now illustrated and described my invention, it is not intended that such description limit this invention, but rather that this invention be limited only by reasonable interpretation of the appended claims.

What is claimed is:

1. A holder for allen wrenches, or the like devices, comprising:

(a) a hollow cylindrical housing including a longitudinal slot at least the length of the longest device to be stored therein and a generally circular thumb hole intermediate said slot's ends;

(b) an interior cylindrical tool-holding rod with a diameter less than the diameter of said housing, said rod rotatably received inside said housing, said rod including a plurality of longitudinal channels disposed around said rod's circumference, each said channel terminating in a bore into said rod, said rod including a circumferential groove intermediate said rod's ends and coaxial with said housing's thumb hole to provide finger access to said wrenches; and, (c) means to rotate said rod within said housing, whereby when a set of wrenches, or the like devices, is placed, one each in its correspondingly sized channel with its head retained in said bore, said rod may be rotated to expose each wrench in turn.

2. The holder for allen wrenches according to claim 1 wherein said means to rotate said rod comprises a handle at at least one housing end, said handle attached to said rod so that turning of said handle rotates said rod.

3. The holder for allen wrenches according to claim 2 wherein there are two handles attached to said rod, one handle at each housing end.

4. The holder for allen wrenches according to claim 1, including, additionally, a support stand, said stand comprising a base with two perpendicularly extending legs, said legs parallel to each other and positioned between said handles and said housing.

5. The holder for allen wrenches according to claim 1 including, additionally, stop means to fix said housing to prevent its rotation.

6. The holder for allen wrenches according to claim 5 wherein said stop means is a pin longitudinally linking said housing to said stand.

7. The holder for allen wrenches according to claim 1 including, additionally, means to lock said rod in a predetermined position.

8. The holder for allen wrenches according to claim 7 wherein said locking means comprises a spring plunger in said rod and a receiving indent for said plunger in said housing's interior wall.

9. The holder for allen wrenches according to claim 1 wherein said rod's channels are of dissimilar widths.

10. A holder for allen wrenches, or the like devices, comprising:

(a) a hollow cylindrical housing including a longitudinal slot at least the length of the longest device to be stored therein and a generally circular thumb hole intermediate said slot's ends;

(b) a cylindrical rod with a diameter slightly less than the diameter of said housing, said rod rotatably received inside said housing, said rod including a plurality of longitudinal channels of different widths disposed around said rod's circumference, each said channel terminating at one end in a bore in said rod, said rod including a circumferential groove intermediate said rod's ends and aligned with said thumb hole, said groove being of a depth and width predetermined to provide finger access to tools stored therein, said rod including a hub at each end;

(c) a pair of handles one each attached to each said hub, so that turning of a handle rotates said rod;

(d) means to lock said rod in a predetermined position; and, (e) stop means to fix said housing to prevent its rotation, whereby when a set of wrenches, or the like device, is placed one each in its correspondingly sized channel with its head extending into said rod's bore, said rod may be rotated to expose each wrench in turn.

11. The holder for allen wrenches according to claim 10 including, additionally, a support stand, said stand comprising a base with two perpendicularly extending legs, said legs parallel to each other and positioned between said handles and said housing.

12. The holder for allen wrenches according to claim 10 wherein said holder is metal.

13. The holder for allen wrenches according to claim 10 wherein said holder is plastic.

14. The holder for allen wrenches according to claim 10 wherein said locking means comprises a spring plunger in said rod and a receiving indent for said plunger in said housing's interior wall.

* * * * *